US005289243A

United States Patent [19]

Sakamoto

[11] Patent Number: 5,289,243

[45] Date of Patent: Feb. 22, 1994

[54] INSTALLATION AND REMOVAL STRUCTURE OF A DEVELOPING UNIT AND A TONER CARTRIDGE IN AN IMAGE FORMING APPARATUS

[75] Inventor: Koji Sakamoto, Tokyo, Japan

[73] Assignee: Ricoh Company, Ltd., Tokyo, Japan

[21] Appl. No.: 992,258

[22] Filed: Dec. 14, 1992

[30] Foreign Application Priority Data

Dec. 18, 1991 [JP] Japan ..... 3-110767[U]

[51] Int. Cl.[5] ..... G03G 15/06

[52] U.S. Cl. ..... 355/260; 222/DIG. 1; 355/200

[58] Field of Search ..... 355/200, 210, 245, 260; 118/653; 222/DIG. 1; 141/364, 375

[56] References Cited

U.S. PATENT DOCUMENTS

| | | | |
|---|---|---|---|
| 4,607,939 | 8/1986 | Saito | 355/200 |
| 4,913,087 | 4/1990 | Saita et al. | 118/653 |
| 4,974,023 | 11/1990 | Aimoto et al. | 355/245 |
| 5,036,358 | 7/1991 | Yoshida | 355/245 X |
| 5,079,589 | 1/1992 | Shibata et al. | 355/245 |
| 5,111,244 | 5/1992 | Koyama et al. | 355/210 |
| 5,115,275 | 5/1992 | Suzuki | 355/245 |
| 5,121,165 | 6/1992 | Yoshida et al. | 355/260 |
| 5,153,643 | 10/1992 | Nagakura | 355/260 X |
| 5,196,884 | 3/1993 | Sugiyama et al. | 355/200 |
| 5,220,385 | 6/1993 | Surti | 355/260 |

FOREIGN PATENT DOCUMENTS

| | | | |
|---|---|---|---|
| 0220285 | 9/1988 | Japan | 355/260 |
| 0220286 | 9/1988 | Japan | 355/260 |
| 0220287 | 9/1988 | Japan | 355/260 |
| 0278267 | 11/1990 | Japan | 355/260 |

*Primary Examiner*—R. L. Moses
*Assistant Examiner*—William J. Royer
*Attorney, Agent, or Firm*—Oblon, Spivak, McClelland, Maier & Neustadt

[57] ABSTRACT

An image forming apparatus includes a developing unit which supplies toner to an image carrier for developing a latent image. A toner cartridge is normally mounted on the developing unit and covers an opening thereof. In order to minimize toner spillage, a lug on the developing unit can cooperate with a stationary projection on the apparatus body to permit installation of the developing unit into the apparatus body only when the toner cartridge is mounted on the developing unit. Alternatively, a lug on the developing unit can cooperate with a stationary projection on the apparatus body for prohibiting mounting or removal of the toner cartridge only when the developing unit is installed in the apparatus. Alternatively, guide ribs are formed on both the developing unit and the toner cartridge for guiding the developing unit and toner cartridge for installation in the apparatus body only when the toner cartridge is mounted on the developing unit. Alternatively, a removal blocking member permits removal of the toner cartridge from the developing unit only when the developing unit is installed in the apparatus body. In a final alternative, a prohibiting member prohibits the removal of the developing unit from the apparatus body when the toner cartridge is not mounted to the developing unit, while a pivotal member and a projection member cooperate to permit the toner cartridge to be mounted on or removed from the developing unit only when the developing unit is installed in the apparatus body.

16 Claims, 6 Drawing Sheets

INSTALLATION AND REMOVAL STRUCTURE OF A DEVELOPING UNIT AND A TONER CARTRIDGE IN AN IMAGE FORMING APPARATUS

BACKGROUND OF THE INVENTION

1. Field of the Invention

The present invention relates to an image forming apparatus such as a copying machine, a printer, a facsimile machine, etc., which records images on a sheet of paper using an electrophotographic process. The invention particularly relates to an improvement in the installation and removal structure of a developing unit, or an image forming process kit including a developing unit, and a toner cartridge in the image forming apparatus.

2. Discussion of the Background

In an image forming apparatus such as a copying machine, a printer, a facsimile machine, etc., using an electrophotographic process, a latent image formed on a photoconductive member is developed by applying toner from a developing unit onto the photoconductive member. The developed image is then transferred and fixed onto a sheet of paper. It is common that a removable toner cartridge is used to supply toner to the developing unit.

In conventional apparatuses in which a toner cartridge is exchanged while in the developing unit, or an image forming process kit, including the developing unit, is positioned inside the apparatus, or where the toner cartridge is exchanged while the developing unit or the image forming process kit is removed from the apparatus, if the developing unit or the image forming process kit can be inserted or removed without the toner cartridge being mounted thereon, a large amount of toner can be spilled and spread inside the image forming apparatus due to installation or removal shock, or due to turbulent air. As a result, the spread toner adheres to optical devices or a corona discharge wire, and printing quality is deteriorated.

Moreover, in conventional apparatuses in which the toner cartridge is exchanged while the developing unit or the image forming process kit is removed from the apparatus, if the toner cartridge can be removed from the developing unit or the image forming process kit while the developing unit or the image forming process kit remains inside the apparatus, the problem described above can occur because an entrance for supplying toner in the developing unit becomes open inside the apparatus.

Finally, in conventional apparatuses in which the toner cartridge is exchanged while the developing unit, or the image forming process kit including a developing unit, is installed inside the apparatus, if the toner cartridge can be installed and removed while the developing unit or the image forming process kit is removed from the apparatus, and if the cartridge is in fact removed from the developing unit or the image forming process kit, the developing unit or the image forming process kit can be overturned and the toner in the developing unit spilled and spread. Also, when the entrance for supplying toner in the developing unit is opened outside of the apparatus, foreign substances can enter the developing unit and cause serious damage.

SUMMARY OF THE INVENTION

It is a first object of the present invention to provide an image forming apparatus with an installation and removal structure of a developing unit, etc., and a toner cartridge which prevents accidental spillage or spreading of the toner.

It is another object of the present invention to provide an image forming apparatus with an installation or removal structure of a developing unit, etc., and a toner cartridge which prevents the toner from spreading inside the apparatus and reducing print quality.

It is another object of the present invention to provide an image forming apparatus with an installation and removal structure of a developing unit, etc., and a toner cartridge which prevents toner from spreading outside of the apparatus.

It is yet a further object of the present invention to provide an image forming apparatus with an installation and removal structure of a developing unit, etc., and a toner cartridge which prevents foreign substances from entering into an open entrance for supplying toner to the developing unit.

According to one feature of the invention, an image forming apparatus comprises an image carrier on which a latent image is formed. A developing unit has means for supplying toner to the image carrier for developing the latent image when the developing unit is installed in a body of the image forming apparatus. The developing unit has an opening through which the toner from a toner cartridge can be introduced thereinto. A toner cartridge is mountable on the developing unit and covers the opening. Means are provided on at least one of the developing unit and the toner cartridge for permitting installation of the developing unit into the image forming apparatus body only when the toner cartridge is mounted on the developing unit.

According to another feature of the invention, there are provided means on at least one of the developing unit and the apparatus body for prohibiting mounting or removal of the toner cartridge on the developing unit only when the developing unit is installed in the image forming apparatus body.

According to yet another feature of the invention, guide means are formed on both the developing unit and the toner cartridge for guiding the developing unit and the toner cartridge for installation in the image forming apparatus body only when the toner cartridge is mounted on the developing unit.

According to yet a further feature of the invention, means are provided on at least one of the developing unit and the toner cartridge for permitting removal of the toner cartridge from the developing unit only when the developing unit is installed in the image forming apparatus body.

According to yet a further feature of the invention, means are provided on at least one of the developing unit, the toner cartridge and the image forming apparatus body for prohibiting the removal of the developing unit from the image forming apparatus body when the toner cartridge is not mounted to the developing unit, and also for permitting the toner cartridge to be mounted on or removed from the developing unit only when the developing unit is installed in the image forming apparatus body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 2(*c*) and 2(*d*) correspond to FIGS. 2(*a*) and 2(*b*), but show the insertion prohibiting member being folded by a rib of the toner cartridge;

FIG. 3(*b*) corresponds to FIG. 3(*a*) but shows the removal prohibiting member moved to an active state;

FIG. 4(*b*) shows the image forming process kit and toner cartridge of FIG. 4(*a*) independent of the image forming apparatus;

FIG. 5(*b*) is a perspective detail of the embodiment of FIG. 5(*a*);

FIG. 6(*b*) is a detail in plan of the embodiment of FIG. 6(*a*).

DETAILED DESCRIPTION OF THE PREFERRED EMBODIMENTS

Referring now to the figures, embodiments of the invention will be described.

Figure 1:
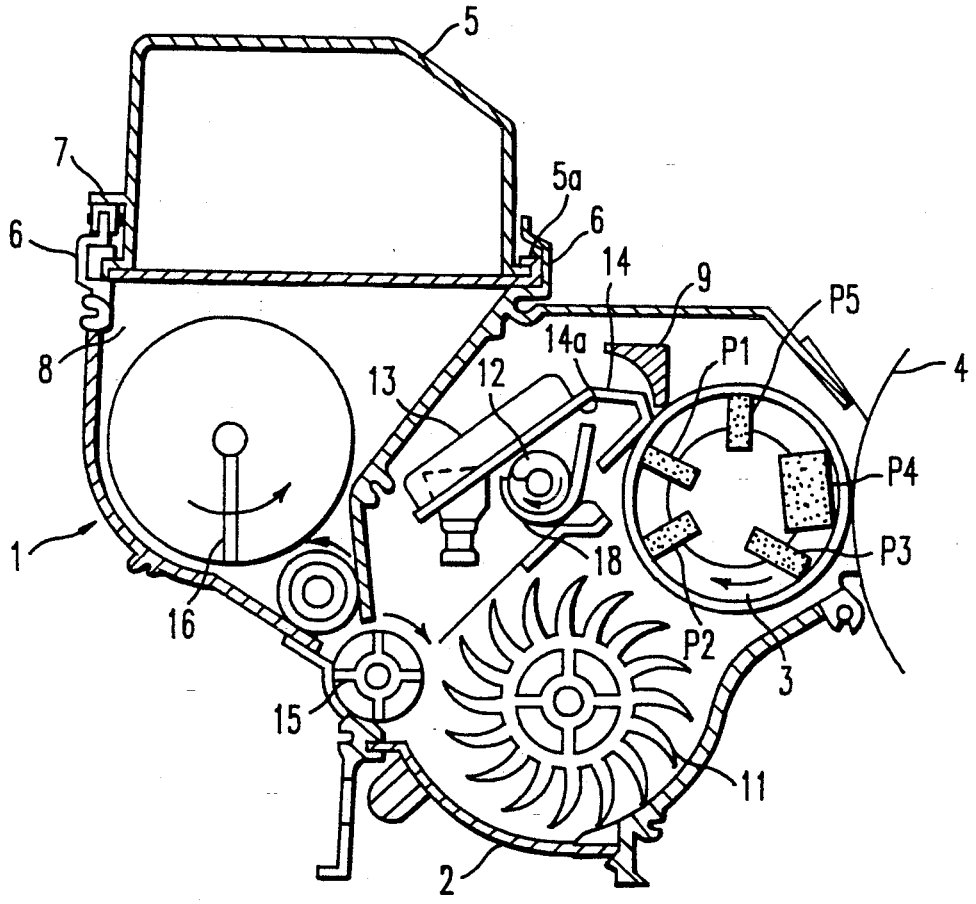
FIG. 1 is a sectional elevation view of a developing unit and toner cartridge according to one embodiment of the invention.
Figure 2A:
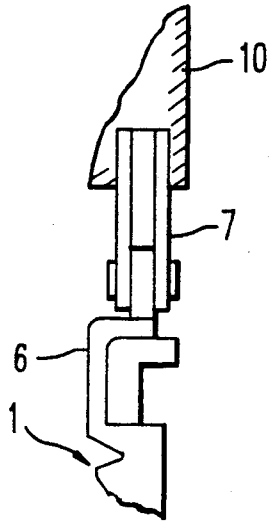
FIGS. 2(*a*) and 2(*b*) are front and side elevation details of the insertion prohibiting members of the embodiment of FIG. 1.
Figure 2B:
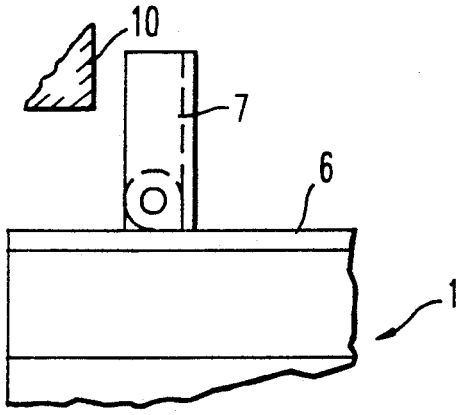
Figure 2C:
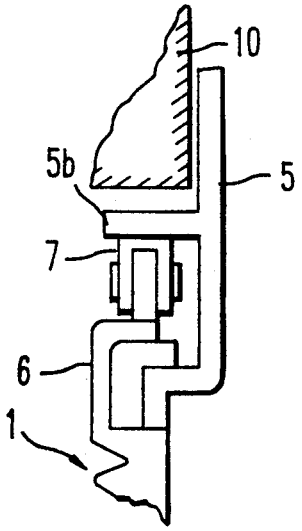
Figure 2D:
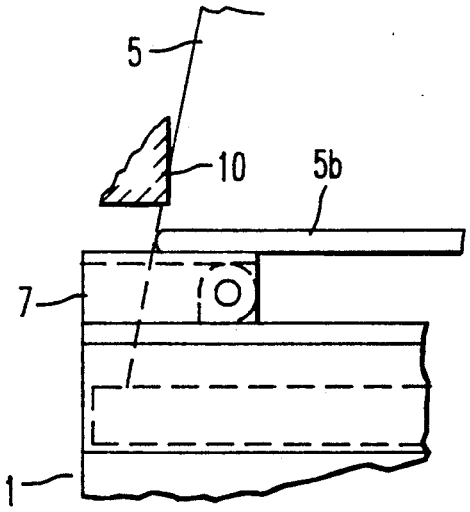

FIG. 1 shows a first embodiment in which the present invention is applied to a two component developing unit.

The structure of the developing unit 1 is as follows. In FIG. 1, a photoconductive member 4 is installed close to a developing roller 3. Magnets P1–P5 are installed within the developing roller 3. A doctor member 9 is installed close to the circumference of the developing roller 3. A paddle wheel 11 is installed below and to the left side of the developing roller 3 and close to it. A unit including a screw member 12, an inclined fin 13, a guide 14 and etc. is installed above the paddle wheel 11. A wing roller is installed in the unit. The developing roller 3, the doctor member 9, the paddle wheel 11, the screw member 12, the inclined fin 13, the guide 14, the wing roller 15 and etc. are enclosed in a casing 2 and developing material circulates while being stirred by them. The toner adheres to the photoconductive member 4 and is consumed. It is also supplied, while being stirred by a stirring member 16, from the toner cartridge 5 toward the wing roller 15.

This developing unit is operated as follows. The developer is carried in the clockwise direction by the paddle wheel 11 and then is carried up in the clockwise direction by the developing roller 3, with its thickness being controlled by the doctor member 9. It is thus put in contact with the photoconductive member 4 for development. Developer remaining on the developing roller after contacting with the photoconductive member 4 is removed from the developing roller 3 by the magnetic field of the magnets P2, P3 and is carried, while being stirred, by the wheel 11. On the other hand, the developer removed by the doctor member 9 is guided by the inclined fin 13 as it falls down the guide 14. The inclined fin 13 moves the developer in the horizontal direction toward one edge of the guide 14 having a hole 14*a*. The developer falls through the hole and onto a member 18 having the screw member 12. The developer is carried horizontally to the opposite edge of the member 18 by the screw member 12 and is dropped from the opposite edge. The developer which is dropped from the guide 14 and the member 18 is stirred by the wing roller 15 and conveyed to the paddle wheel 11.

The upper end of the toner tank 2 has an opening 8 through which toner can be introduced into the toner tank. The opening is normally closed by a toner cartridge 5. The toner cartridge 5 has flanges 5*a* which fit within guide rails 6 attached to the developing unit at opposite sides of the opening 8. As a result, the toner cartridge 5 can slide relative to the developing unit in a direction perpendicular to the plane of FIG. 1 for installing or removing the toner cartridge on the developing unit 1.

Although not shown in FIG. 1, the developing unit 1 can be installed or removed from the image forming apparatus by movement in a direction perpendicular to the plane of FIG. 1. Means are provided for permitting installation of the developing unit 1 in the body of the image forming apparatus only when the toner cartridge 5 is mounted on the developing unit 1. In for example, element 10 of FIGS. 2(*a*)–2(*d*) represents a blocking projection stationarily mounted in the image forming apparatus body. The projection 10 cooperates with an insertion prohibiting member described below to prevent installation of the developing unit into the image forming apparatus unless the toner cartridge is mounted thereon.

Referring to FIGS. 2(*a*) and 2(*b*), the insertion prohibiting member comprises a lug 7 pivotally mounted to the guide rail 6 for rotation in the direction of arrow A from the standing position of FIGS. 2(*a*) and 2(*b*). A spring (not shown) normally biases the lug in the standing or prohibiting position. When in the standing position, the lug 7 abuts the projection 10 of the image forming apparatus body as the developing unit is being inserted within the image forming apparatus, and prevents such insertion.

Referring to FIGS. 2(*c*) and 2(*d*), the toner cartridge 5 has a means for moving the lug 7 to a folded position, for example, a rib 5*b*. When the toner cartridge is fully installed on the developing unit 1 by sliding the flanges 5*a* within the guide rails 6, the rib 5*b* abuts the lug 7 and pivots the lug 7 to the folded position, as seen in FIG. 2(*d*), so that the lug 7 can no longer act to prevent insertion of the developing unit into the apparatus. Therefore, the insertion prohibiting apparatus assures that the developing unit will be inserted in the image forming apparatus body only when the toner cartridge is fully installed thereon, thereby preventing the danger of spillage and spread of toner due to shock or air turbulence.

Figure 3A:
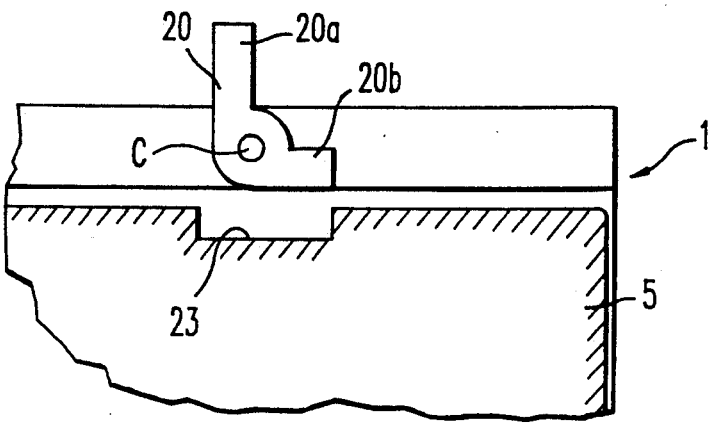
FIG. 3(*a*) is a detail of a plan view of a second embodiment, showing another removal prohibiting member.
Figure 3B:
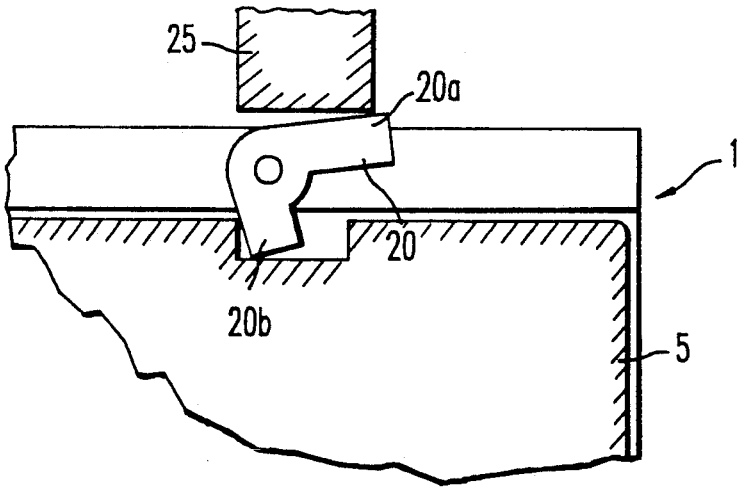

Referring to the embodiment of FIGS. 3(*a*) and 3(*b*), FIG. 3(*a*) shows a partial plan view of a developing unit 1 having the toner cartridge 5 installed thereon, in which the toner cartridge can be removed from the developing unit by relative movement in the direction of the arrow.

Means are provided for prohibiting mounting or removal of the toner cartridge on the developing unit only when it is installed on the apparatus body. For example, a removal prohibiting member is comprised by a generally L shaped lug 20 which is pivotally mounted to the developing unit 1 for rotation about center C. It includes both a first projection part 20*a* and a second projection part 20*b*. A spring (not shown) biases the lug 20 normally in the free position shown in FIG. 3(*a*) in which it does not interfere with the movement of the toner cartridge 5 relative to the developing unit 1. Therefore, the toner cartridge can be installed or removed for exchange.

However, as the developing unit 1 is being installed in an image forming apparatus, the image forming apparatus body includes a projection 25 (FIG. 3(*b*)) mounted at a fixed position. As the developing unit approaches the fully installed position of FIG. 3(*b*), the projection 25 abuts the first projection part 20*a* and causes the lug 20 to pivot to the position of FIG. 3(*b*), at which time the second projection part 20*b* enters the concavity 23 in the toner cartridge and prevents the toner cartridge from moving in the direction of the arrow, relative to the developing unit 1. Therefore, the toner cartridge cannot be installed or removed from the developing unit while the developing unit is installed within the image forming apparatus, thereby assuring that toner cannot be spilled and spread within the image forming apparatus due to shock or air turbulence.

It should also be noted that the structure of FIG. 3(*a*) and 3(*b*) prevents the developing unit from being installed within the image forming apparatus when the toner cartridge 5 is only partly, and not fully, installed on the developing unit 1. In the case of partial installation of the toner cartridge on the developing unit, the concavity 23 will not be aligned with the lug 20, and the toner cartridge will prevent the removal prohibiting member from pivoting to the position of FIG. 3(*b*), thereby preventing installation of the toner cartridge 1.

Figure 4A:
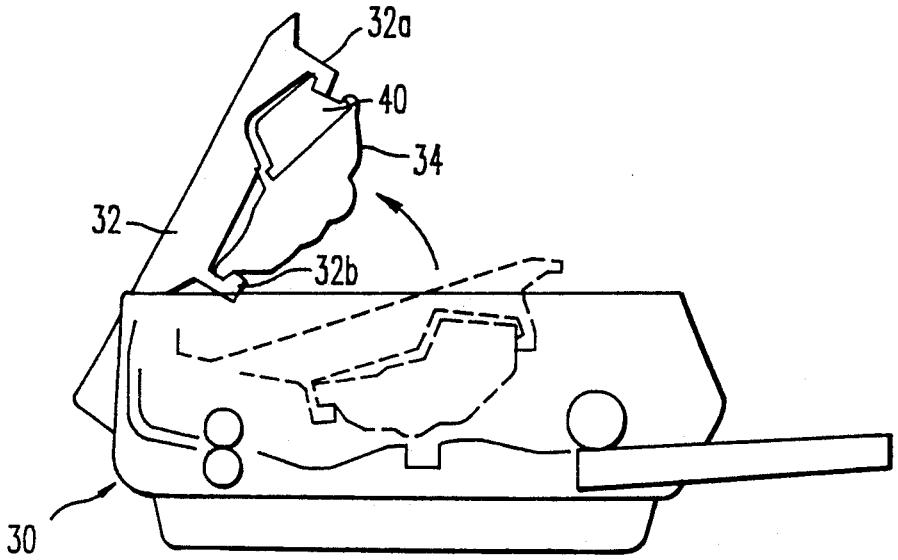
FIG. 4(*a*) is a schematic elevation of an image forming process kit and toner cartridge of another embodiment, installed in an image forming apparatus.
Figure 4B:
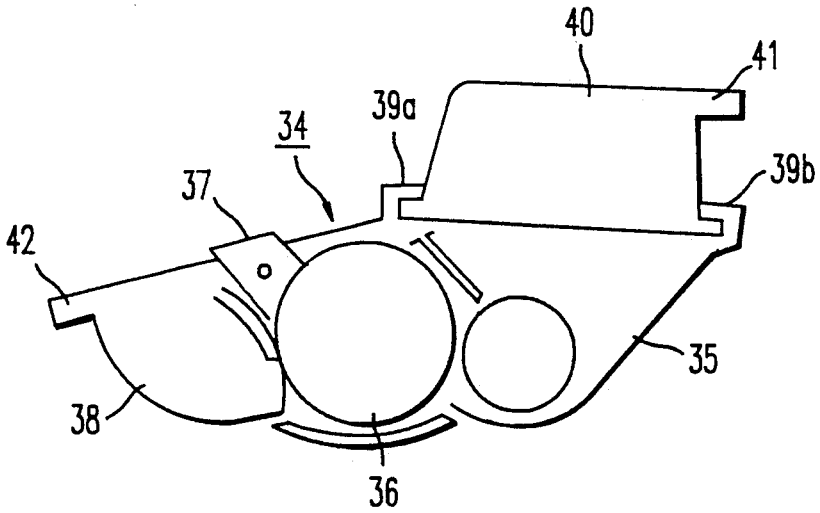

Referring to the embodiment of FIGS. 4(*a*) and 4(*b*), in this embodiment, an image forming process kit 34 includes a developing unit 35, a photosensitive body 36, a corona charger 37 and a cleaning unit 38. A pair of guide rails 39*a* and 39*b* cooperate with flanges of the toner cartridge 40 to permit the toner cartridge to be installed or removed from the image forming process kit by sliding in a direction perpendicular to the plane of the figures. The toner cartridge 40 also includes a rib 41, while the image forming process kit includes a rib 42.

Referring to FIG. 4(*a*), the image forming apparatus 30 has a pivoting cover 32 including a pair of guide rails 32*a* and 32*b*. The ribs 41 and 42 can cooperate with the guide rails 32*a* and 32*b* for installation or removal of the image forming process kit on the cover 32. Therefore, since one of the support ribs is on the toner cartridge while the other is on the image forming process kit, it is only when the two are first united via the guide rails 39*a* and 39*b* that the entire assembly can be installed on the cover 32. Neither the image forming process kit 34 nor the toner cartridge 40 can be installed separately from the other.

Therefore, there cannot exist an open entrance for supplying toner to the developing unit 35 and the spillage and spread of the toner within the apparatus can be minimized.

Figure 5A:
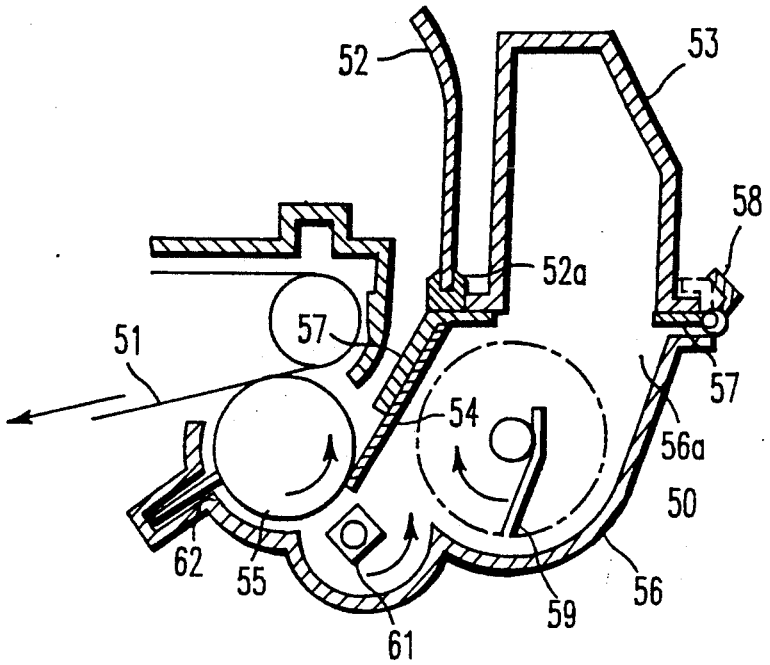
FIG. 5(*a*) is a sectional elevation view of another embodiment of the invention.
Figure 5B:
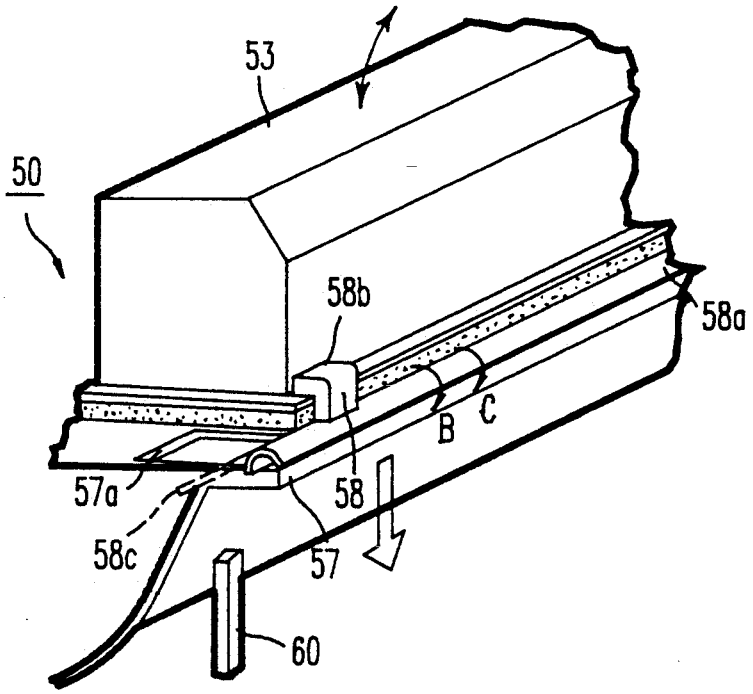

FIGS. 5(*a*) and 5(*b*) show a further embodiment incorporated into a one component developing unit. In the embodiment of FIG. 5(*a*), the developing unit 50 is installed in the image forming apparatus body (not shown). This type of image forming apparatus body is of the "clamshell" type in which an upper structure is pivotally mounted on a lower structure to open and close like a clamshell. In this case, the developing unit is mounted in the lower structure, while a photoconductor belt 51 and a cover 52 are together mounted on the upper structure. FIG. 5(*a*) shows the photoconductor belt 51 and the upper cover 52 in the closed position wherein the upper cover rests on part 57 of the developing unit and forms a sealed closure via the grommet 52A.

The toner is supplied from the toner cartridge 53 into the toner tank 56 and is carried in the direction of the developing roller 55 by a toner mixing plate 59. A toner supply bar 61 is installed near the developing roller 55 and works to steadily supply the toner to the developing roller. On the surface of the developing roller 55 is formed a rubber magnet layer having poles spaced at intervals of 1 mm in the circumferential direction.

The magnet captures the magnetic one component toner by its magnetic field. Then the developing roller rotates in the counterclockwise direction and the thickness of the toner is controlled by a metal toner metering blade 57 whose edge touches slightly the surface of the developing roller 55 and at the same time it is charged by the friction of the blade 54. Then when the toner reaches the photoconductor belt 51 which has a latent image, the toner adheres to the photoconductor 51 and the development is done. After the development, the surface of the developing roller 55 is discharged by a conductive bias brush 62.

The developing unit includes a toner tank 56 and a developing roller 55 which engages the photoconductor 51 when the cover 52 is closed, so as to transfer toner onto the photoconductor 51 for developing a latent image thereon. The developing unit is otherwise conventional, except as noted below.

A toner cartridge 53 is used to supply toner to the developing unit 50. It normally contains toner and has an opening normally closed by a seal (not shown). The seal is torn away after installation, at which time the toner cartridge is installed on the opening 56*a* of the toner tank of the developing unit 50 from above.

It is desirable in this embodiment that the toner cartridge can be installed or removed from the developing unit only when the developing unit is inside the image forming apparatus body, and fixed thereto. Therefore, the toner cannot be spread inside the apparatus and foreign substances cannot be put into the developing unit because the opening of the developing unit 50 is covered by other units inside the image forming apparatus.

In order to assure that the toner cartridge 53 can only be installed or removed from the developing unit 50 when the developing unit is installed in the image forming apparatus body. The developing unit includes means for permitting removal of the toner cartridge from the developing unit only when the developing unit is installed on the image forming apparatus body. For example, an installation part 57 is formed around the edge of the opening 56*a* of the toner tank 56, and a removal blocking member 58 is mounted to the installation part 57. The removal blocking member 58 includes a rotation part 58*a* pivotally mounted to the installation part 57 and rotatable in either direction shown by the arrows "C" in FIG. 5(*b*). A spring (not shown) biases the rotation part 58*a* in the counterclockwise direction, as seen in FIG. 5(*b*). A member 58*b*, which has a "L" shape, is mounted on the rotation part 58*a*, and so is biased by the spring into the blocking position shown in FIG. 5(*b*) in which it latches onto a flange of the toner cartridge 53, and prevents the toner cartridge from being removed from the developing unit.

A stationary projection 60 is formed inside the image forming apparatus body at such a location that it can extend through the opening 57*a* in the installation part 57 as the developing unit 50 is moved downward and into its installed position. Once the developing unit has moved fully downward to its installed position, which is below the position shown in FIG. 5(*b*), the projection 60 abuts a member 58*c* which extends laterally from the rotation part 58*a* and into the opening 57*a*. Projection 60 thus pivots the blocking member 58 in the clockwise direction, and against the biasing force of the spring, to the unblocking position shown by solid lines in FIG. 5(*a*), when the developing unit is in the fully installed position. Therefore, the toner cartridge 53 can be removed from the developing unit only when the blocking member 58 has been pivoted by the projection 60 and the developing unit is in its fully installed position within the image forming apparatus body. Toner therefore cannot be spread outside of the apparatus and foreign substances cannot be put into the developing unit 50 because the toner cartridge 53 maintains its opening 56*a* closed when the developing unit is not fully installed within the image forming apparatus.

Figure 6A:
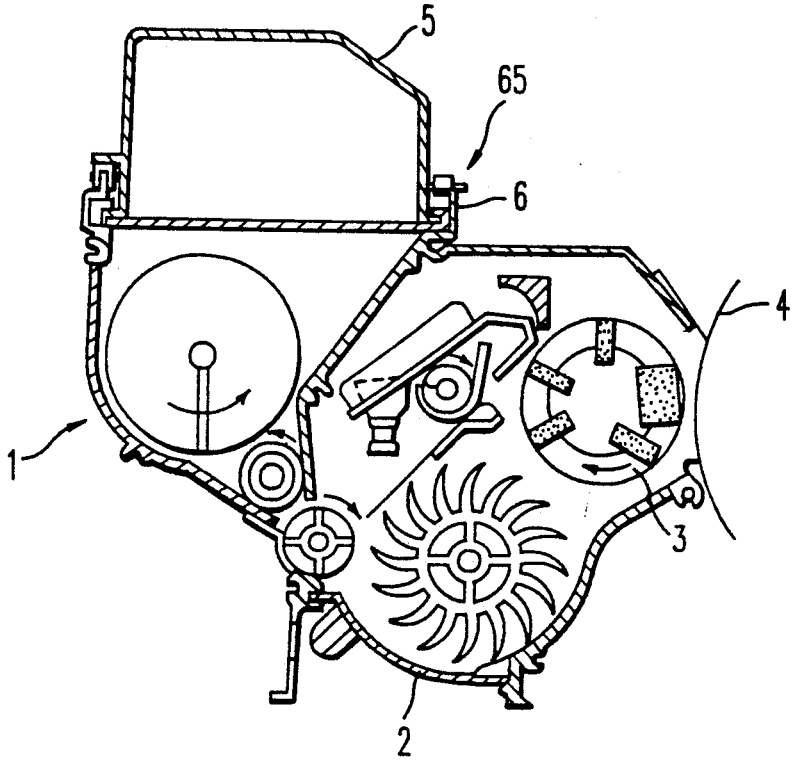
FIG. 6(*a*) is a sectional elevation view of yet another embodiment of the invention.
Figure 6B:
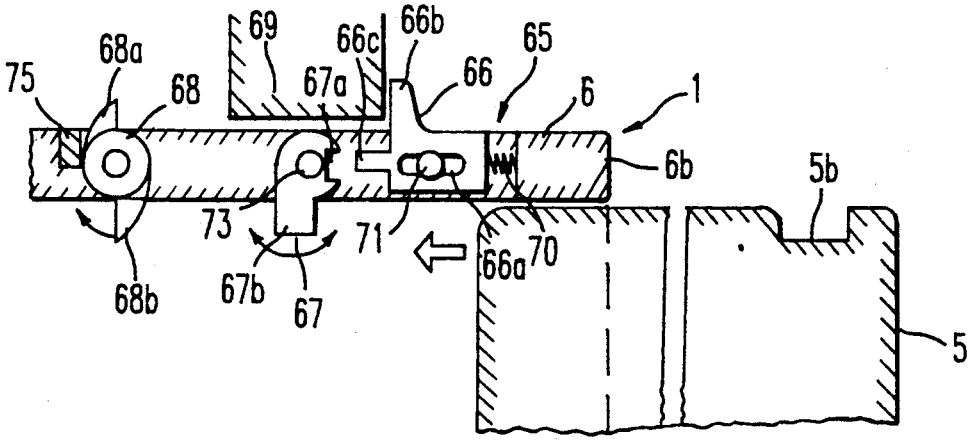

The embodiment of FIGS. 6(*a*) and 6(*b*) includes means for preventing the toner cartridge from being installed on or removed from the developing unit when the developing unit is not installed within the image forming apparatus body, and also for preventing the developing unit from being removed from the image forming apparatus body when the toner cartridge is not installed thereon.

Referring to FIG. 6(*a*), a developing unit shown therein is similar to that shown in FIG. 1, except with respect to the error operation preventing structure 65 described below.

Referring to FIG. 6(*b*) which is a plan detail of the developing unit 1, the error operation preventing structure 65 includes a projection member 66 and an installation and removal member 67. The projection member 66 is slidably mounted on the developing unit by a pin 71 which fits in the elongate slot 66*a* of the projection member 66. The installation and removal member 67 is rotatably mounted on the developing unit 1 via a pin 73. It includes a concavity 67*a* and a projection 67*b*. Springs, not shown, normally keep the installation and removal member rotationally oriented in the position shown in FIG. 6(*b*) wherein the projection 67*b* projects inwardly while the concavity 67*a* faces a projection 66*c* of the projection member 66. While not illustrated in FIG. 6(*b*), the spring 70 normally biases the projection member 66 fully to the left so that the projection 66*c* fits in the concavity 67*a*, thereby preventing rotation of the installation and removal member 67 from the orientation shown in the figures.

The projection member 66 also includes a projection 66*b* which projects into engagement with the stationary projection 69 of the image forming apparatus body when the developing unit is fully installed in the image forming apparatus body, as is shown in FIG. 6(*b*).

An error operation preventing member 68 is rotatably mounted on the developing unit 1 and has two radially projecting nails 68*a* and 68*b*. A spring normally rotates the error operation preventing member 68 in the counterclockwise direction until limited by the first rotation preventing member 75.

FIG. 6(*b*) shows the developing unit 1 fully installed in the image forming apparatus. In this position, the projection member 66 is retracted by the engagement of the projection 66*b* with the stationary projection 69, and so the installation and removal member 67 is free to rotate. Therefore, as the toner cartridge 5 is moved to the left (as seen in the figure) during its mounting on the developing unit, its leading edge first rotates the installation and removal member 67 in the clockwise direction, and then rotates the error operation preventing member 68 in the clockwise direction. When the toner cartridge 5 has reached the fully installed position, the installation and removal member 67 is able to pivot counterclockwise so that the projection 67*b* fits into the concavity 5*b* of the toner cartridge 5, while the error operation preventing member 68 remains pivoted in a clockwise direction so that the nail 68*a* no longer projects into the path of the stationary projection 69. Therefore, the toner cartridge can be fully installed and the developing unit can be removed from the image forming apparatus without interference from the error operation preventing member 68. However, when the toner cartridge is not installed, the nail 68*a* abuts the stationary projection 69 to prevent removal of the developing unit 1.

Once the developing unit is removed from the image forming apparatus, however, the projection member 66 is able to slide under the biasing action of the spring 70 until it mates with the concavity 67*a*, thereby preventing pivoting of the installation and removal member 67, and so preventing removal of the toner cartridge 5 from the developing unit.

Therefore, according to this embodiment the toner cartridge 5 cannot be installed to or removed from the developing unit 1 outside of the image forming apparatus, although this can be done when the developing unit is within the image forming apparatus. Therefore, the toner cannot be spread outside of the apparatus and foreign substances cannot be put into the developing unit. Moreover, since the developing unit cannot be removed from the image forming apparatus without the toner cartridge mounted thereon, there can be no removal shock which will cause the spread of toner in the apparatus.

While the invention has so far been described with reference to embodiments having a developing unit, it may be appreciated that it is equally applicable to an image forming apparatus which uses an image forming process kit in which case the installation permitting means, the mounting or removal prohibiting means, the guide means, the removal permitting means and the removal prohibiting means will be associated with the image forming process kit in the same way that they are associated with the developing unit in the above embodiments.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An image forming apparatus comprising:

an image carrier on which a latent image is formed;

a developing unit having means for supplying toner to the image carrier for developing the latent image when the developing unit is installed in a body of the image forming apparatus, the developing unit having an opening through which toner from a toner cartridge can be introduced thereinto;

a toner cartridge mountable on said developing unit and covering said opening; and means on at least one of said developing unit and said toner cartridge for permitting installation of said developing unit into the image forming apparatus body only when said toner cartridge is mounted on said developing unit.

2. The image forming apparatus of claim 1 wherein said means for permitting installation comprise:

a stationary projection mounted to the image forming apparatus body;

an insertion prohibiting member mounted to said developing unit and movable between a prohibiting position in which said prohibiting member engages said stationary projection to prevent installation of said developing unit, and a folded position;

means for normally biasing said insertion prohibiting member to the prohibiting position; and means on said toner cartridge for moving said insertion prohibiting member to said folded position when said toner cartridge is mounted on said developing unit.

3. The image forming apparatus of claim 2 wherein said insertion prohibiting member comprises a lug pivotally mounted to said developing unit and said means for moving comprise a rib on said toner cartridge, which rib engages and folds said lug when said toner cartridge is installed on said developing unit.

4. An image forming apparatus comprising:

an image carrier on which a latent image is formed;

a developing unit having means for supplying toner to the image carrier for developing the latent image when the developing unit is installed in a body of the image forming apparatus, the developing unit having an opening through which toner from a toner cartridge can be introduced thereinto;

a toner cartridge mountable on said developing unit and covering said opening; and means on at least one of said developing unit and said apparatus body for prohibiting mounting or removal of said toner cartridge on said developing unit only when said developing unit is installed in the image forming apparatus body.

5. The image forming apparatus of claim 4 wherein said prohibiting means comprises:

a stationary projection mounted to the image forming apparatus body;

a removal prohibiting member mounted to said developing unit and movable between a position in which the removal prohibiting member prohibits mounting or removal of said toner cartridge on said developing unit and a free position in which said mounting or removal is not prohibited; and means for normally biasing said removal prohibiting member to said free position, wherein said stationary projection is so mounted relative to said developing unit when said developing unit is installed in the image forming apparatus body that said stationary projection engages said removal prohibiting member and moves said removal prohibiting member to the prohibiting position when said developing unit is installed in the image forming apparatus body.

6. The image forming apparatus of claim 5 wherein said removal prohibiting member is pivotally mounted to said developing unit and includes a first projection which engages said stationary projection, and a second projection.

7. The image forming apparatus of claim 6 wherein said toner cartridge includes a concavity in which said second projection of said removal prohibiting member fits only when the toner cartridge is fully installed on said developing unit and said removal prohibiting member is in the prohibiting position.

8. An image forming apparatus comprising:

an image carrier on which a latent image is formed;

a developing unit having means for supplying toner to the image carrier for developing the latent image when the developing unit is installed in a body of the image forming apparatus, the developing unit having an opening through which toner from a toner cartridge can be introduced thereinto;

a toner cartridge mountable on said developing unit and covering said opening; and guide means formed on both said developing unit and said toner cartridge for guiding said developing unit and toner cartridge for installation in the image forming apparatus body only when said toner cartridge is mounted on said developing unit.

9. The image forming apparatus of claim 8 wherein said guide means comprise:

guide rails on said image forming apparatus body;

a first rib cooperating with one of said guide rails and mounted to said developing unit; and a second rib cooperating with another of said guide rails and mounted to said toner cartridge.

10. An image forming apparatus comprising:

an image carrier on which a latent image is formed;

a developing unit having means for supplying toner to the image carrier for developing the latent image when the developing unit is installed in a body of the image forming apparatus, the developing unit having an opening through which toner from a toner cartridge can be introduced thereinto;

a toner cartridge mountable on said developing unit and covering said opening; and means on at least one of said developing unit and said toner cartridge for permitting removal of said toner cartridge from said developing unit only when said developing unit is installed in the image forming apparatus body.

11. The image forming apparatus of claim 10 wherein said means for permitting removal of said toner cartridge comprise:

a removal blocking member pivotally mounted to said developing unit and movable between a blocking position in which removal of the toner cartridge from the developing unit is blocked and an unblocking position in which said removal is permitted;

means for normally biasing said removal blocking member in the blocking position; and a stationary projection mounted to the image forming apparatus body at such a location that the stationary projection engages and moves said removal blocking member to said unblocking position when said developing unit is fully installed in the image forming apparatus body.

12. The image forming apparatus of claim 11 wherein said removal blocking member comprises:

a rotating part rotatably installed on said developing unit;

an L-shaped member mounted to the rotating part and engagable with said toner cartridge; and a member which is mounted to the rotating part and is engaged by said stationary projection.

13. An image forming apparatus comprising:

an image carrier on which a latent image is formed;

a developing unit having means for supplying toner to the image carrier for developing the latent image when the developing unit is installed in a body of the image forming apparatus, the developing unit having an opening through which toner from a toner cartridge can be introduced thereinto;

a toner cartridge mountable on said developing unit and covering said opening; and means on at least one of said developing unit, said toner cartridge and the image forming apparatus body for prohibiting the removal of said developing unit from the image forming apparatus body when said toner cartridge is not mounted to said developing unit.

14. The image forming apparatus of claim 13 including means on at least one of said developing unit, the image forming apparatus body and said toner cartridge for permitting said toner cartridge to be mounted on or removed from said developing unit only when said developing unit is installed in the image forming apparatus body.

15. The image forming apparatus of claim 14 wherein said means for prohibiting removal comprise:

a stationary projection mounted to the image forming apparatus body;

a prohibiting member mounted to said developing unit and movable between a prohibiting position in which said prohibiting member engages said stationary projection to prevent removal of said developing unit, and a folded position;

means for normally biasing said prohibiting member in the prohibiting position; and means on said toner cartridge for moving said prohibiting member to said folded position when said toner cartridge is mounted on said developing unit.

16. The image forming apparatus of claim 15 wherein said permitting means comprise:

a concavity in said toner cartridge;

a pivotal member mounted to said developing unit, said pivotal member having a concavity and a projection which can enter said concavity of said toner cartridge only when said toner cartridge is fully mounted to said developing unit;

a projection member movably mounted to said developing unit and having a first projection which can enter said pivotal member cavity to lock the pivotal position of said pivotal member when said projection of said pivotal member is in said concavity of said toner cartridge, and a second projection which can engage said stationary projection of the image forming apparatus body; and means for normally biasing said projection member such that said first projection is in said concavity of said pivotal member, wherein said stationary projection is positioned such that said second projection engages said stationary projection and moves said projection member such that said first projection is positioned out of said concavity of said pivotal member when said developing unit is fully installed in the image forming apparatus body.

* * * * *